United States Patent [19]

Takahashi

[11] Patent Number: 4,657,377

[45] Date of Patent: Apr. 14, 1987

[54] IMAGE FORMATION APPARATUS WITH VARIABLE DENSITY CONTROL

[75] Inventor: Shinkichi Takahashi, Yokohama, Japan

[73] Assignee: Canon Kabushiki Kaisha, Tokyo, Japan

[21] Appl. No.: 736,343

[22] Filed: May 21, 1985

Related U.S. Application Data

[63] Continuation of Ser. No. 570,518, Jan. 13, 1984.

[30] Foreign Application Priority Data

Jan. 24, 1983 [JP] Japan ..... 58-9699

[51] Int. Cl.[4] ..... G03G 15/00

[52] U.S. Cl. ..... 355/14 R; 355/14 D; 355/14 E

[58] Field of Search ..... 355/3 R, 14 E, 14 R, 355/14 D, 3 DD, 8, 68; 118/691, 665, 653, 646; 430/30, 120

[56] References Cited

U.S. PATENT DOCUMENTS

| | | | |
|---|---|---|---|
| 4,124,294 | 11/1978 | Nakamura | 355/68 |
| 4,200,391 | 4/1980 | Sakamoto et al. | 355/14 D X |
| 4,215,930 | 8/1980 | Miyakawa et al. | 355/14 D |
| 4,348,099 | 9/1982 | Fantozzi | 355/14 E |
| 4,352,553 | 10/1982 | Hirahara | 355/14 E |
| 4,354,758 | 10/1982 | Futaki | 355/68 |
| 4,372,674 | 2/1983 | Yukawa et al. | 355/14 D |
| 4,377,338 | 3/1983 | Ernst | 355/3 DD X |
| 4,533,238 | 8/1985 | Miyazaki | 355/14 E X |

FOREIGN PATENT DOCUMENTS 141646 11/1979 Japan .

*Primary Examiner*—A. C. Prescott

*Attorney, Agent, or Firm*—Fitzpatrick, Cella, Harper & Scinto

[57] ABSTRACT

An image forming apparatus including a controller for controlling the density of an image to be formed corresponding to a source of information, said controller including a detector for receiving a signal corresponding to information of image density, a corrector device for comparing the results detected by the detector with a predetermined value and correcting the image density controller in accordance with the results obtained by the comparison and image process device for forming an image having a proper density and corresponding the source of information in accordance with the image forming condition characteristics obtained after the controller has been corrected by the corrector device.

5 Claims, 7 Drawing Figures

IMAGE FORMATION APPARATUS WITH VARIABLE DENSITY CONTROL

This is a continuation of application Ser. No. 570,518, filed Jan. 13, 1984.

BACKGROUND OF THE INVENTION

1. Field of the Invention

The present invention relates to an image forming apparatus comprising means for automatically controlling the density of a formed image.

The present invention is also effective for use in systems such as copying systems, laser-beam printers, printing machines and the like in which an image is to be formed on an image bearing member having a photosensitive layer in accordance with image information from an original object such as a document and which comprises an automatic image density controlling mechanism having means for detecting optical or potential information corresponding to the image information.

2. Description of the Prior Art

In the conventional imge forming systems such as copying machines and others, an automatic adjustment has been carried out to make an image clearer by controlling its density even if there are different densities for different images. This automatic adjustment is convenient and more reliable than manual adjustment, when originals of different densities are to be copied.

Even if there is such an advantage, the prior art image forming systems cannot avoid improper functions or malfunctions due to some change of the preset process conditions with the passing of time and due to the contamination of optical components such as lenses, mirrors and others.

Japanese Laid-open Patent Application No. 141646/1979 discloses means for overcoming the malfunction based on the change of the preset process conditions. A measurement is compared with a reference value to control the output of an original exposure lamp, the development bias of a developing device or others. However, such comparison and control is time-consuming. In a high-speed copying machine, images may be processed before the comparison and control of the value is completed, so that an entirely proper image cannot be obtained.

U.S. Pat. No. 4,215,930 discloses means for overcoming the malfunction based on the contamination of the lenses and mirrors. This proposal utilizes the same method as in the aforementioned Japanese Laid-open Patent Application for controlling the potential of a lamp, the width of a slit through which an light image can be transmitted, the charge to a photosensitive member and so on. Therefore, this U.S. Patent device also has the same problem.

It is also known in the art to program or incorporate image formation conditions into a circuitry for effecting a preselected calculation on the premise that means for detecting the potential or the amount of light is stable in sensitivity. This will be called "image formation characteristics". In accordance with the detected conditions of image density from a source of information, proper image formation conditions can normally be obtained from the above image formation characteristics.

However, if the means for detecting the potential or the amount of light as information of image density is varied in sensitivity for any reason such as the deposition of toner, the deposition of dust or the reduction of its own sensitivity, the automatic image density adjusting system will malfunction repeatedly so that no proper image will be obtained. Such a problem cannot be overcome by the above described prior art.

SUMMARY OF THE INVENTION

It is an object of the present invention to provide an apparatus which can more reliably and safely control the density of an image while maintaining the superior advantages which are provided by the prior art automatic image density adjusting mechanism.

Another object of the present invention is to solve said problems in the prior art and to provide an apparatus which can properly form an image even when means for detecting the information of image density varies in its sensitivity.

Still another object of the present invention is to provide an apparatus which can more quickly and reliably deal with the variations of sensitivity.

Further objects of the present invention will be apparent from the following description.

DESCRIPTION OF THE PREFERRED EMBODIMENTS

Figure 1:
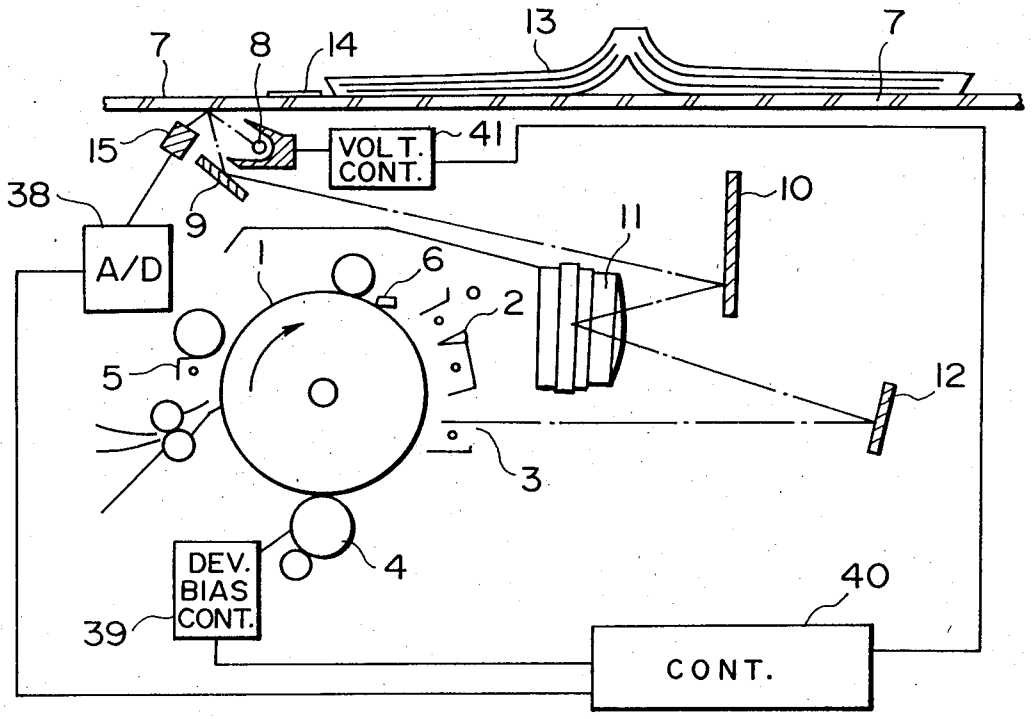
FIG. 1 is a schematic view illustrating an electrophotographic apparatus including an image density controlling means.

Referring to FIG. 1, an electrophotographic system is shown comprising a drum-like photosensitive member 1, a sensitizing charger 2, an image exposure section 3, a developing section 4, a transfer section 5, a cleaning section 6, a carriage of glass 7 on which an original to be copied 13 is placed, a light source 8 for illuminating the original 13, light transmitting mirrors 9, 10 and 12, and a lens 11. The photosensitive member 1 is rotated in the direction of the arrow. During this rotation, the photosensitive member 1 is uniformly charged by the charger 2 and then exposed to the light image from the original to form an electrostatic image at the image exposure section 3. The electrostatic image is then developed at the developing section 4 with the developed image being transferred to a transfer sheet at the transfer section 5 to form a copy. After the transfer step, the photosensitive member 1 is cleaned at the cleaning section 6 and may be re-used to form another copy in the same cycle.

Prior to the above-mentioned copy forming process, the original 13 and a reference plate 14 which is located out of the imaging area are irradiated by the light from the light source 8 with the resulting reflective lights being measured by a photoreceptor 15. The reference plate 14 has a reflection density substantially equal to that of the white background of the normal original,for example, about 0.08. Thus, there are previously determined characteristic curves representing a relationship between the output of the photoreceptor 15 and the voltage for the energization of the light source and a relationship between the output of the photoreceptor 15 and the density of the original, when the characteristics of the photosensitive member 1 and light source 8 are placed and kept in their normal conditions. By using such calculating means, a proper voltage for the energization of the light source can be determined for each of various different densities of the original so that the image density will properly be controlled.

This adjustment of density can properly be carried out only when the photoreceptor 15 is stable in its operation. In accordance with information obtained from the reflected light from the original and reference plate 13, 14, image forming characteristics for controlling the density of the image are used to control the voltage of the light source, the bias voltage of development, the exposure, the opening of an aperture or the charging, singly or in combination. If the photoreceptor 15 used as means for detecting the density signal from the source of information is varied in its characteristics for any reason, for example, due to dust deposited thereon, the detection of density will not be accurately effected in accordance with the predetermined characteristics. As a result, the desired density of image will not be obtained. This will adversely affect subsequent steps.

Some specific disadvantages produced by the varied characteristics of the photoreceptor 15 will be described below.

Figure 2:
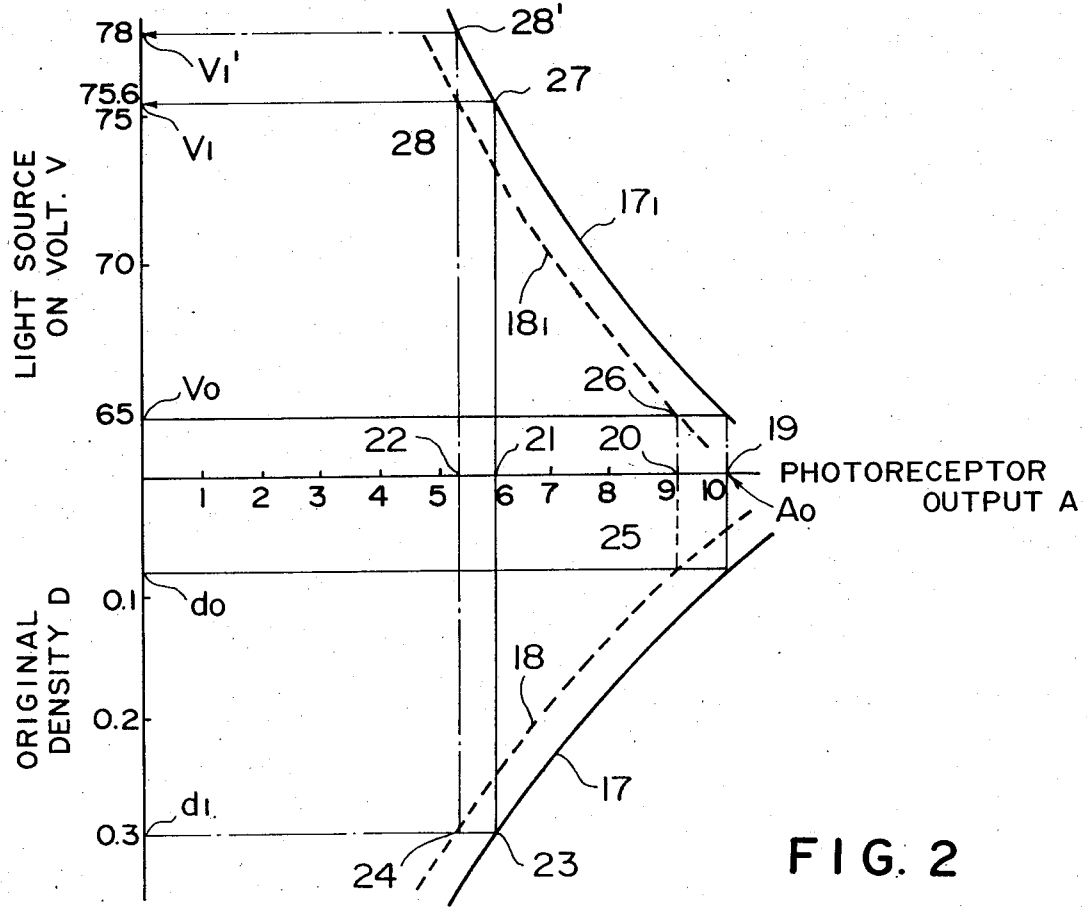
FIG. 2 is a view showing relationships between the outputs of photoreceptors and the voltages for energizing light sources and original densities in the present invention and the prior art.

FIG. 2 shows characteristic curves representing a relationship between the output A of the photoreceptor 15 and the light source voltage V and a relationship between the output A of the photoreceptor 15 and the original density D. Curves $\mathbf{17}_1$ and 17 are those characteristic curves obtained when the characteristics of the photosensitive member 1 and light source 8 are maintained normal. This is an example of the pre-selected image formation characteristics. If the output of the light source 8 at the previously determined light source voltage V (for example, 65 V), and the input and output of the photoreceptor 15 are in their normal conditions, the original 13 having the density D (e.g. d1=0.3) is irradiated by the light source 8 which properly illuminates the original. For example, the output A of the photoreceptor 15 will be in a value 6 at a point 21 corresponding to a point 23 on the curve 17 when the original density is d1. Thus, the light source voltage V corresponding to the output point 21 of the photoreceptor 15 will be 75.6 V as shown at a point $V_1$ corresponding to a point 27 on the curve $\mathbf{17}_1$. This voltage is used to automatically adjust the density of image.

However, if the characteristics of the photoreceptor 15 are varied for any reason, it will not produce a proper value at its output even though the original is irradiated by the exposure lamp under the normal voltage 65 V. For example, if the photoreceptor 15 reads the original 13 as having its density of 0.3 as shown at the point d1, the automatic control of image density is carried out based still on the curve $\mathbf{17}_1$ so that the original will be subjected to exposure by the light source under a voltage 78 V as shown at a point $V_1'$ corresponding to a point 28' on the curve $\mathbf{17}_1$. The resulting image will be reduced in density since the used voltage (78 V) is higher than the normal voltage (75.6 V).

As seen from the foregoing, the prior art image density control used in the image forming system may abnormally be operated since the variations of the photoreceptor 15 and associated components are not taken into consideration.

Now, embodiments of the present invention will be described with reference to the drawings.

Figure 3:
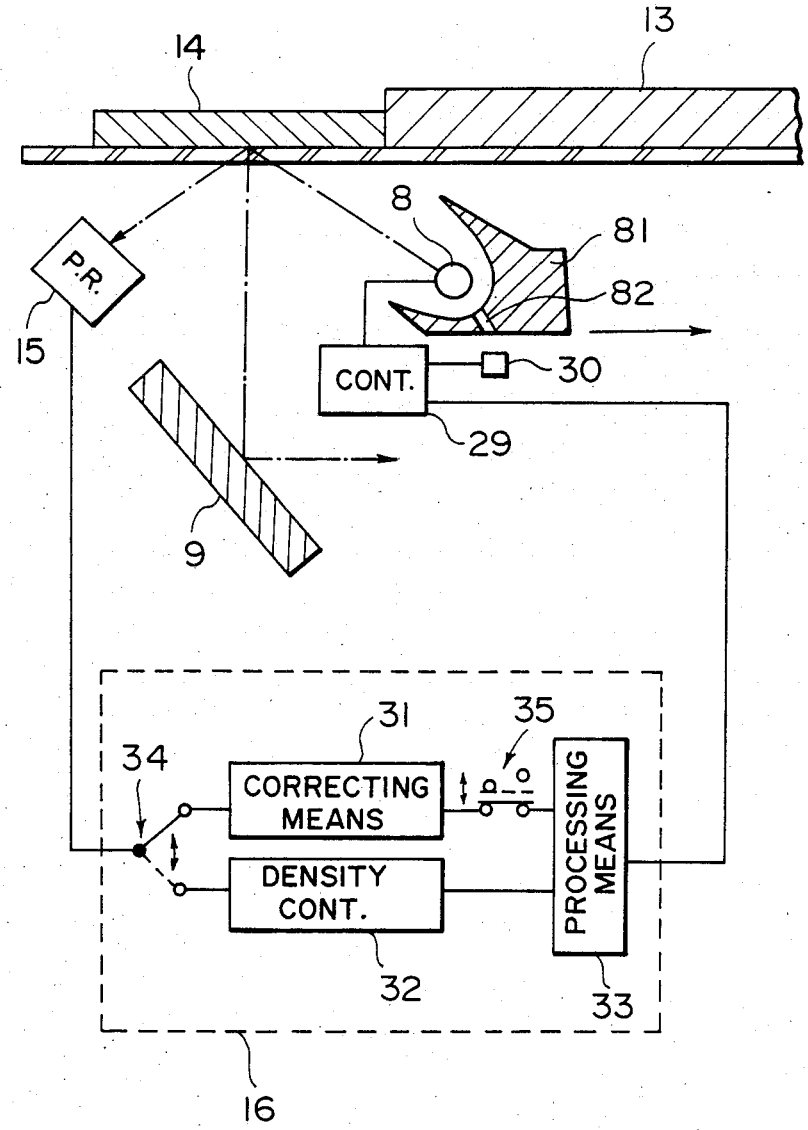
FIG. 3 is a view showing the main parts of the first embodiment according to the present invention.

FIG. 3 shows the main parts of the first embodiment of the present invention in which the reference plate 14 is located in the same plane as that of the original 13 and spaced away from the light source 8 and photoreceptor 15 by the same distance as in the original 13. The reference plate 14 has a specified reflection density d0 (=0.08, which is substantially equal to that of the normally used original having a white-colored background). The reference plate 14 serves to provide a reflective light causing the normal photoreceptor 15 to produce its initial output A0 (=10) when this reference plate 14 is irradiated by the normal light source 8 under the previously determined voltage V0 (=65 V). Upon the start of the system, the reference plate 14 is irradiated by the light source 8 while upon the formation of image, the original 13 is irradiated with the light fro the light source 8 to detect the density therein or to form a latent image. Around the light source 8 is a reflector 81 having an opening 82 located at a position which will not interfere with the exposure step. A detector 30 for detecting the light from the light source 8 is disposed adjacent to the lower end of the opening 82. A control means 29 is provided which functions to control a voltage to the light source 8. Normally, a pre-selected voltage V0 equal to 65 V is applied to the light source 8 by the control means 29. This pre-selected voltage V0 normally causes the photoreceptor 15 to produce a signal representing the density 0.08 for the reference plate 14 so that the light source 8 will produce a predetermined amount of light to effect the control compatible with the curves 17 and $\mathbf{17}_1$ which represent the previously determined image formation characteristics. However, if the detector 30 does not receive the predetermined amount of light from the light source 8 due to any variation of output or abnormal condition, the control means 29 will control the voltage to be applied to the light source 8 so that the light from the light source will be stabilized. Thus, any reduction of sensitivity in the photoreceptor can be more accurately detected.

There is provided means 16 for automatically adjusting the density of image. This means 16 is manually selected by the operator and supplies to the light source control means 29 a signal for automatically controlling the image information from the original 13 to compensate for the reduction of sensitivity in the photoreceptor 15. In the automatic mode, therefore, the light source control means 29 produces a voltage corresponding to the above signal, which is applied to the light source 8 for exposure.

When the automatic image density adjustment mode is selected by an operator, the reference plate 14 is exposed to the light of a predetermined amount with the resulting reflective light being supplied to the photoreceptor 15. The photoreceptor 15 in turn produces the output signal corresponding to the above reflective light which is in turn supplied to the automatic image density adjustment means 16. At this time, switches 34 and 35 located within the automatic image density adjusting means 16 are in positions as shown by the solid line in FIG. 3. Thus, only means 31 for correcting the image formation characteristics is actuated. This correcting means 31 is effective to translationally move the curves 17 and $17_1$, representing the predetermined characteristic conditions, parallel to the axis of photoreceptor output A in FIG. 2 in accordance with the output signal of the photoreceptor 15 corresponding to the density d0 of the reference plate 14. For example, if this output signal is equal to the value 10 at a point A0 under the normal condition in FIG. 2, the curves 17 and $17_1$ will be selected. However, if the photoreceptor 15 is abnormal, the above output signal indicates a value 9, for example, at a point 20 rather than at the point A0. Therefore, the correcting means 31 selects a curve $18_1$ obtained by translating the curve $17_1$ so that the signal corresponding to the value 9 will indicate the light source voltage of 65 V corresponding to the point A0. The coordinates at the point 26 designate (9, 65). Similarly, the correcting means 31 selects a curve 18 corresponding to the curve 17 in which the coordinates at the point 25 denote (9, 0.08). In this manner, the photoreceptor 15 can be corrected without any change of the light source voltage V at the beginning of the automatic adjustment such that the density of the original 13 can be accurately detected to set the optimum image formation conditions.

The selected curve $17_1$ or $18_1$ represents the correct image control characteristics which will be supplied to processing means 33.

Thereafter, the switches 34 and 35 are changed to their other positions as shown by the broken line in FIG. 3. This provides the normal image density detection mode. At the same time, the light source 8 emits the predetermined amount of light to scan the original 13 partially or wholly. Thus, the photoreceptor 15 receives the reflective light from the original 13 to produce a corresponding signal which is in turn supplied to the density detecting means 32. This density detecting means 32 detects the density of the original by using the known processing means, for example, means for determining the average density, the background density or the type of the original, based on integration or comparison. Thus, the processing means 33 will produce a signal corresponding to the density on the original 13.

The processing means 33 determines an optimum light source voltage V in accordance with the proper image control characteristics corrected by the correcting means 31 and with the output signal of the density detecting means 32. If the density d1 of the original is equal to 0.3 on the curves 17 and $17_1$, the optimum voltage is equal to 75.6 V. In this case, the voltage $V_1$ is determined to be equal to 75.6 V on the points 23, 27. Under an abnormal condition in which the curves 18 and $18_1$ are selected, the voltage $V_1$ is determined to be equal to 75.6 V on the points 24 and 28. In this manner, the optimum light source voltage V corresponding to the density of the original can be properly determined independently of the condition of the photoreceptor 15.

The so determined voltage is applied to the light source 8 through the control means 29 so that the original will be irradiated by the light. Thus, any image can be formed with its stable and optimum density and without affection of the state of the photoreceptor 15.

Thus, operation only on the curve $17_1$ without the above correction can be avoided, with the result that the point 28' is selected.

Figure 4:
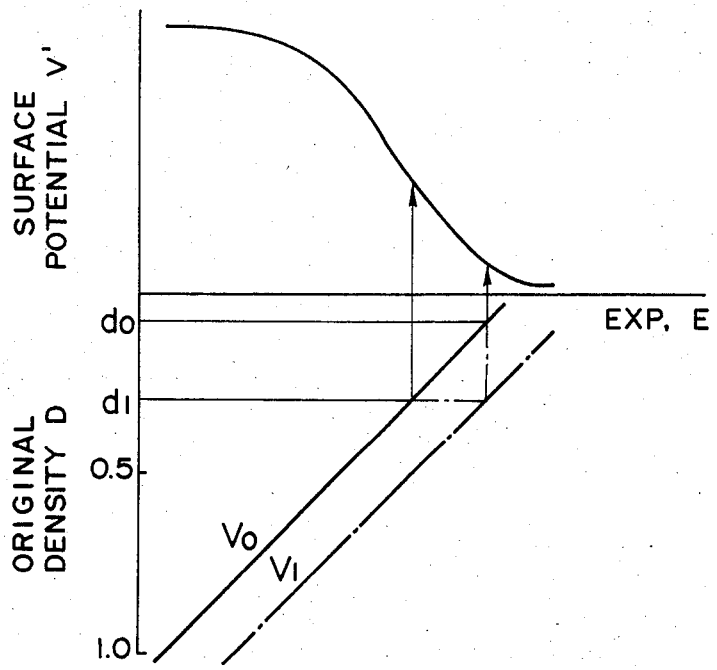
FIG. 4 is a view showing relationships between exposures and surface potentials on a photosensitive member and original densities.

The relationship between the light source voltage V and the output A of the photoreceptor 15, that is, the optimum image formation characteristics are determined based on the relationship between the exposure E and the surface potential V' on the surface of the photosensitive member 1 (E−V' characteristics) as shown in FIG. 4.

In general, the E−V' characteristics are obtained in accordance with the sensitivity of a photosensitive member used and considered to be substantially stable although there is a slight change due to variations of ambient temperature and humidity. The light source voltage V is represented by a straight line having its positive inclination as shown in FIG. 4 and can be translated to determine the relationship between the original density D and the surface potential V'.

The control system 40 shown in FIG. 1 will be described below.

The light source voltage V from the photoreceptor 15 may be controlled as shown in FIG. 3. However, the total control means 40 may include a memory section and a calculating section so that the information of density from the photoreceptor 15 will be supplied to the control means 40 through an A/D converter 38 to effect the calculation and correction as shown in FIG. 3. And, after the image formation characteristics have been changed or maintained constant, the normal image density control may automatically be carried out. The light source 8 is coupled to means 41 for changing the applied voltage.

Figure 6:
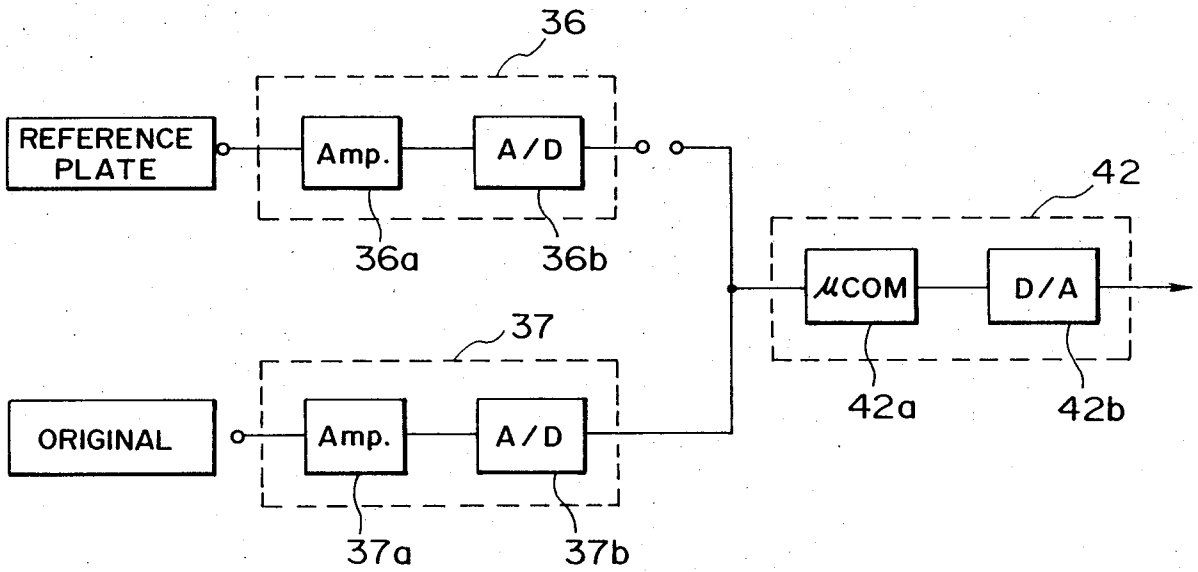
FIG. 6 is a block diagram showing the main parts in the present invention.
Figure 7:
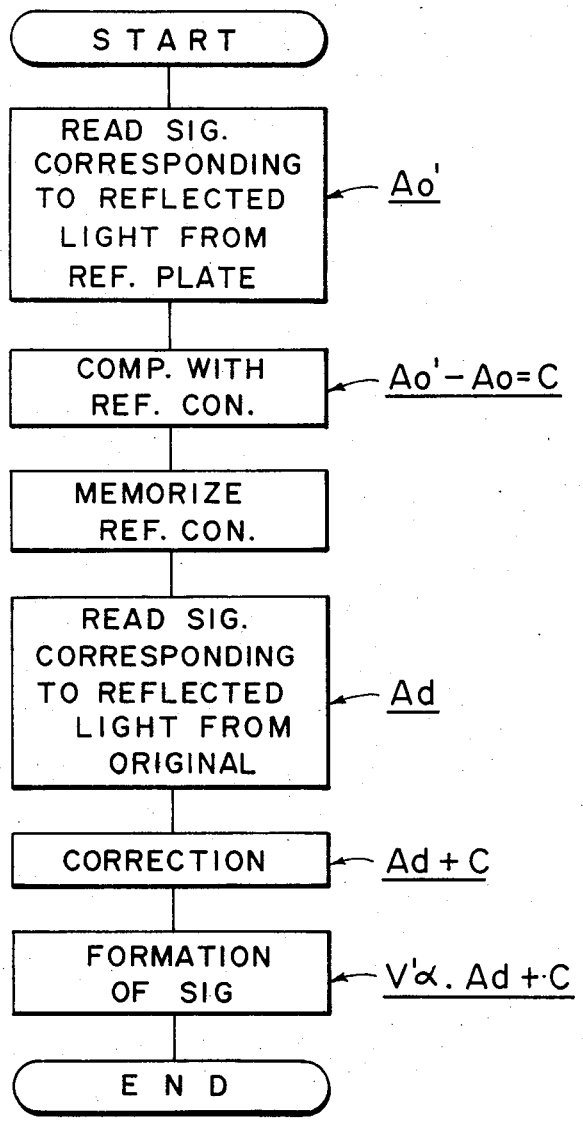
FIG. 7 is a flow chart illustrating the operation of the main parts in the present invention.

The description will be carried out with reference to FIGS. 6 and 7.

Light reflected by the reference plate 14 is incident on the photoreceptor 15 whereat the light is photoelectrically converted into an analog signal which is in turn amplified by an amplifier **36*a* and then converted into a digital signal by an A/D converter 36*b*. The digital signal is supplied to a microcomputer 42*a*** whereat this signal is compared with a reference value A0 with its difference being stored.

Light reflected by the original 13 is also incident on the photoreceptor 15 whereat the light is photoelectrically converted into an analog signal. The analog signal is amplified by an amplifier **37*a* and then converted into a digital signal by an A/D converter 37*b*. The digital signal is supplied to the microcomputer 42*a* whereat the previously compared amount is considered in addition to this digital signal to calculate a control signal. The control signal is converted into an analog signal by a D/A converter 42*b* with the analog signal used to control the light amount control means. Reference numeral 39 designates development bias control means in the developing section 4**.

Figure 5:
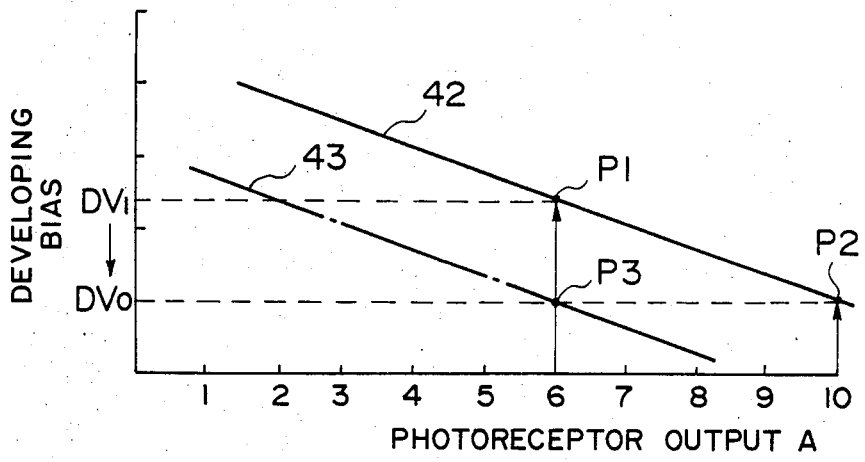
FIG. 5 is a view showing a relationship between the output of a photoreceptor and developing bias voltage.

The second embodiment of the present invention will be described below. FIG. 5 shows an example of the characteristic curves representing a relationship between the development bias voltage V and the output A of the photoreceptor, when control means (38, 39, 40) for changing the development bias voltage is used in place of the control means 29 for changing the light source voltage in the first embodiment. When this characteristic curves are used, they may be corrected by the same correcting means to adjust the density of image so that the same results will be obtained as in the first embodiment.

As a specific example, if the output obtained from the reference plate 14 is equal to 6 and if the reference bias voltage is $DV_0$ under the normal condition for the output of 10 in accordance with the predetermined image formation characteristics curve 42, $DV_1$ obtained from the output of 6 will undesirably be larger than $DV_0$. Thus, prior to the detection of the original density, the characteristics curve 42 is corrected. In other words, it is shifted such that a point P1 (6, $DV_1$) will indicate a point P3 (6, $DV_0$) to provide the normal bias voltage. Thus, many cycles of control will not be required until the point P1 reaches the point P2. A proper image can be obtained more positively and quickly.

Although the previous embodiments have been described as to the detector 30 for correcting the amount of light in the light source 8, the latter has a stable property which provides substantially a constant amount of light with a very slight correction and without a larger effect. However, this is important in that the light source 8 is stabilized.

In the third embodiment of the present invention, the detection of the reference plate 14 and original density for forming an image is carried out under an initial constant voltage (for example, 65 V) and the above detector 30 is omitted. In such an arrangement, a proper image can be obtained even if the output of the light source is varied due to use for a relatively long time period.

In the fourth embodiment of the present invention, when the initial voltage (65 V) to the light source 8 in the first embodiment including the detector 30 is largely varied from the predetermined value into another voltage $V_2$ to obtain a predetermined voltage, the light source voltage (for example, $V_1$) obtained by the above correction means 31 is added by a differential voltage ($V_2-V_0$) through any suitable known means with the resulting combined voltage used to form a latent image of the original 13. In this manner, a proper image can be formed with the desired density.

Although the previous embodiments have been described as to the movable light source type electrophotographic system, the present invention can be applied to original moving type electrophotographic systems.

As seen from the foregoing, the present invention overcomes the problems in the prior art such as the control of density being adversely affected by any malfunction of the photoreceptor due to its variations of characteristics or other variations and provides correcting means for correcting the malfunction of the photoreceptor such that the formation of image can always be carried out with stable conditions of image density. The electrophotographic system can more safely and positively be operated relative to various different densities of image in various sources of information. Therefore, the present invention provides a very reliable image forming apparatus.

While the invention has been described with reference to the structures disclosed herein, it is not confined to the details set forth above, and this application is intended to cover such modifications or changes as may come within the purposes of the improvements or the scope of the following claims.

What is claimed is:

1. An image forming apparatus comprising:

a reference member for providing reference density information;

illuminating means for illuminating said reference member and an original to be copied;

density detecting means for receiving light from said reference member and light from the original when each is illuminated by said illuminating means;

determining means for determining an image forming condition in accordance with density information detected by said density detecting means from light from the original and predetermined control characteristics;

changing means for changing the control characteristics, prior to determination of the image forming condition, in accordance with density information detected by said density detection means from light from said reference member; and means for forming an image of the original in accordance with the image formation condition determined by said determining means.

2. An image forming apparatus according to claim 1, wherein said changing means includes processing means for changing the control characteristics by an amount corresponding to the difference between predetermined reference density information and the density information detected by said density detecting means from light from said reference member.

3. An image forming apparatus according to claim 1 or claim 27, further including means for stabilizing the illumination of said reference member and the original by said illuminating means at a predetermined level prior to changing the control characteristics and determining the image forming condition, wherein said changing means uses an output signal provided by said detecting means when the illuminating means illuminates said reference member at the predetermined level to change the control characteristics and said determining means uses an output signal provided by said detecting means when the illuminating means illuminates the original at the predetermined level to determine the image forming condition.

4. An image forming apparatus comprising:

means for forming an image of an original with a variable image formation parameter;

a reference member having a predetermined reference density;

illuminating means for illuminating said reference member and the original;

first detecting means for detecting light from said illuminating means;

illumination control means for controlling said illuminating means to provide a predetermined light output, said illumination control means being responsive to said first detection means;

second detecting means for receiving light reflected by said reference member when illuminated by said illuminating means and light reflected by the original when illuminated by said illuminating means and for producing outputs representing the densities detected thereby;

means for determining the image formation parameter on the basis of density determining characteristics and the output of said second detecting means with respect to light reflected by said reference member; and changing means for changing the density determining characteristics, prior to determination of the image forming condition, in accordance with the output of said second detecting means with respect to light reflected by the original.

5. An image forming apparatus according to claim 4, wherein said changing means includes processing means for changing the density determining characteristics by an amount corresponding to the difference between predetermined reference density information and density information detected by said second density detecting means with respect to light reflected by said reference member.

* * * * *

UNITED STATES PATENT AND TRADEMARK OFFICE

CERTIFICATE OF CORRECTION

PATENT NO. : 4,657,377

DATED : April 14, 1987

INVENTOR(S) : Takahashi, Shinkichi

It is certified that error appears in the above-identified patent and that said Letters Patent is hereby corrected as shown below:

Col. 1, line 24, "imge" should read -- image --

Col. 1, line 53, "an" should read -- a --

Col. 4, line 25, "fro" should read -- from --

Col. 8, line 18, "27," should read -- 2, --

Signed and Sealed this

Twenty-ninth Day of September, 1987

*Attest:*

DONALD J. QUIGG

*Attesting Officer* *Commissioner of Patents and Trademarks*